US005199310A

United States Patent [19]

Yoshimura

[11] Patent Number: 5,199,310

[45] Date of Patent: Apr. 6, 1993

[54] DRIVING DEVICE FOR CABLE TYPE WINDOW REGULATOR

[75] Inventor: Tatuo Yoshimura, Nishinomiya, Japan

[73] Assignee: Nippon Cable System Inc., Takarazuka, Japan

[21] Appl. No.: 720,334

[22] Filed: Jun. 25, 1991

[30] Foreign Application Priority Data

Jun. 26, 1990 [JP] Japan ..... 2-169083
Jun. 26, 1990 [JP] Japan ..... 2-169084
Jun. 26, 1990 [JP] Japan ..... 2-169085

[51] Int. Cl.[5] ..... E05F 11/48

[52] U.S. Cl. ..... 74/89.2; 74/505; 49/352; 242/54 R; 254/339; 254/342

[58] Field of Search ..... 74/89.2, 89.22, 505; 49/352; 242/54 R; 254/339, 342

[56] References Cited

U.S. PATENT DOCUMENTS 4,194,605 3/1980 Sessa ..... 49/352 X
4,306,378 12/1981 Fukura et al. ..... 49/352
4,428,250 1/1984 Becker et al. ..... 74/89.22 X
4,503,732 3/1985 Schust ..... 74/505 X
4,597,223 7/1986 Shiraishi et al. ..... 74/89.22 X
4,753,125 6/1988 Fukumoto et al. ..... 49/352 X
4,770,056 9/1988 Becker et al. ..... 74/89.2 X
4,821,589 4/1989 Fukumoto et al. ..... 74/89.22
4,839,990 6/1989 Lam et al. .

FOREIGN PATENT DOCUMENTS 2952408 7/1981 Fed. Rep. of Germany ..... 74/505

*Primary Examiner*—Allan D. Herrmann
*Assistant Examiner*—William O. Trousdell
*Attorney, Agent, or Firm*—Nikaido, Marmelstein, Murray & Oram

[57] ABSTRACT

A driving device for a cable type window regulator. The device has a housing, a drum for winding and unwinding cables for actuating a window glass and a balance spring for urging the drum. The device further has a rotatable member which is separated from the drum, and a set of gears for transmitting a torque between the drum and the rotatable member, and the spiral spring is arranged concentrically with the rotatable member so as to directly urge the rotatable member in a rotational direction.

14 Claims, 7 Drawing Sheets

DRIVING DEVICE FOR CABLE TYPE WINDOW REGULATOR

BACKGROUND OF THE INVENTION

The present invention relates to a driving device for a cable type window regulator, and more particularly, to a device for actuating cables in a cable type window regulator used for opening/closing a window of an automobile, a building or the like.

As a driving device for a cable type window regulator, there has been hitherto known a device which has a spiral spring (balancing spring) for obtaining a balance between an operational force for lifting a window glass and a force for lowering the window glass (For example, U.S. Pat. Nos. 4,440,354, 4,662,236, 4,628,759. Such spiral spring is, for example as shown in FIG. 10, housed in a casing or housing 51 and is arranged concentrically with a drum 50 for winding and unwinding wires or cables 64, 65.

In such a case, a spiral spring 52 is generally attached to a disk-like rotatable member. Further in the example of FIG. 10, the spiral spring 52 is housed in a cup-like spring case 53, so as to be well protected by the spring case. The outer end and the inner end of the spiral spring 52 are respectively engaged with the inner wall of the spring case 53 and a boss 54 of the housing 51. Then the spiral spring 52 urges the spring case 53 to rotate in the direction of arrow P.

Further, a driving shaft 55 is rotatably supported with the above-mentioned boss 54 and a center hole of a cover or lid 56, and a manually operated crank handle 57 is securely attached to an end of the driving shaft 55. The spring case 53 and the drum 50 are freely rotatably mounted on the driving shaft 55 and are engaged with each other through a set of ring-like ratchet teeth 58, 59.

At the upper end surface of the drum 50, an engaging projection 60 is provided so that the engaging projection 60 can engage with side edges of a fan-like cut-off portion 62 of a flange 61. The flange 61 has a cup-like shape and is fixed to the driving shaft 55.

Between the outer surface of the flange 61 and the inner surface of the lid 56, a known brake spring 63 is inserted.

The first cable 64 and the second cable 65 wrapping the drum 50 are respectively introduced outward through holes 66, 67 formed in the housing 51.

Such driving device is attached to a door panel of an automobile as a part of window regulator, for example, as shown in FIG. 5.

In FIG. 5, numeral 68 denotes a driving device, and the device 68 is fixed to the door panel together with a guide rail 69. On the other hand, a carrier plate 72 is attached to the window glass 71. To the carrier plate 72, the first cable 64 and the second cable 65 extending from the driving device 68 are anchored. As a result, those cables 64, 65 form a closed loop substantially.

In the above-mentioned driving device, when the window glass 71 is descended, the sprial spring 52 is wound up so as to increase the load, and when the window glass is ascended, the rebound force of the sprial spring 52 is utilized to reduce the load, and therefore, operational forces of ascending direction and descending direction are advantageously balanced.

However, in the conventional window regulator, there happens a case that rain drops or the like sticking to the cables are caught with the cables on the drum 50, and the drum 50 and the spiral spring 52 get wet. Then, rusting occurs on the spiral spring 52, and the strength and durability of the spiral spring 52 are lowered. And further, sliding resistance between slidable members becomes large. As a result, the driving device is functionally disordered.

An object of the present invention is to eliminate the above-mentioned problems of the conventional driving device, and to provide a driving device for a cable type window regulator having good rust-durability.

Further, in the conventional driving device, when weight of the window glass is large, a large crank handle 57 should be employed or a small drum should be employed in order to design the operational force within a suitable extent.

However, the effective turning radius of the crank handle is limited from a requirement of operational convenience, and the radius of the drum is limited from the minimum radius of curvature of the wire or cable. Then, the balancing force is insufficient. On the contrary, in such case that the urging force of the spiral spring is intended to enlarge, very large spiral spring 52 and spring case 53 are required. In addition, there is a problem that various sizes of spring case (and therefore, housing) should be prepared in accordance with the weight of window glass.

The second object of the present invention is to eliminate the above-mentioned problems, and to provide a driving device for a window regulator, in which a sufficient balancing force can be obtained for relatively heavy window glass, and a suitable balancing force can be obtained by merely changing a few parts in accordance with the weight of window glass.

Further, there is general antinomic problem in the size of spiral spring. That is to say, even if a large spiral spring can be employed, a spring with large spring-coefficient cannot secure good durability for repeated large torque.

On the contrary, if durability can be secured, a torque sufficient to balance the weight of window glass cannot be obtained.

Therefore, the present invention is also directed to a driving device for a window regulator which achieves both the above-mentioned antinomic properties (high torque and high durability) in a spiral spring, without sizing-up (especially in the direction of thickness of door panel).

SUMMARY OF THE INVENTION

According to the present invention, there is provided a driving device comprising (a) a housing, (b) a drum rotatably supported by the housing, for winding and unwinding cables for actuating window glass, (c) a rotatable member rotatably supported by the housing, which is separated from the drum, (d) a spiral spring arranged concentrically with the rotatable member so as to urge the rotatable member in a rotational direction, and (e) a means for transmitting a torque between the drum and the rotatable member.

The driving device of the present invention is assembled in a window regulator so that the spiral spring is wound up when the window glass is lowered, and is allowed to expand when the window glass is lifted.

An actuating means or driving means, e.g. a crank handle or a reduction electric motor, might be connected with either the drum side or the rotating member side.

In the above-mentioned driving device, when the drum is driven to rotate, one of cables is wound around the drum, and another cable is unwound from the drum. Therefore, a closed loop of the cables circulates in a direction, and then, for example, the carrier plate 72 of FIG. 5 ascends or descends along the guide rail 69.

At the same time, the rotatable member, which is linked with the drum through a torque transmitting means, rotates to wind up the spiral spring when the window glass descends, and the operation is assisted by the urging force of the spiral spring when the window glass is lifted. Therefore, the open/close operations of the window can be performed smoothly.

In the driving device of the present invention, the drum wrapped by cables to which rain drops might stick and the rotatably member to which the spiral spring is attached are separately arranged and supported in the housing. Therefore, the rain drops do not reach the spiral spring through the drum.

It is preferable that the rotatable member is provided with a spring case for covering the spiral spring in order to protect the spring from rain drops. Further, it is preferable that the inner space of the housing is separated by a partition to form a compartment for the drum and a compartment for the rotatable member (spring case). In such case, even if the drum compartment becomes wet, the spring compartment is well protected from insertion of water, and water-proof property is further improved.

In a further preferable case, the rotational axis of the drum is parallel with the rotational axis of the rotatable member, and the torque transmitting means comprises a first gear formed on the peripheral portion of the rotatable member and a second gear meshing with the first gear and being concentrically connected with the drum in a torque-transmittable manner.

In such driving device, when the window glass is heavy, the gears can be easily designed such that the diameter of the second gear is larger than the first gear in order to perform reduction function. Then, the operational force of the driving device is reduced and the urging torque of the spiral spring to be transmitted to the drum is enlarged.

In the above-mentioned device, when the device is operated, according to the gear-ratio of the first and second gears, the torque of the spiral spring is enlarged (reduction gear) or reduced (maltplying gear) and is transmitted to the drum. Then the operational force is well balanced with the weight of the window glass.

Therefore, a good balancing load matching the weight of the window glass can be obtained, and the operation of the window regulator becomes smooth. Further, since such change of balancing load can be easily performed by only changing the gear ratio of the first and second gears, the remaining parts, e.g. the spiral spring and the housing can be employed as they are for various kind of driving devices commonly.

In the device of the present invention, an additional spiral spring or springs might be housed in a cup-like drum or might be attached to a second (and third) rotatable member which is separated from the above-mentioned (first) rotatable member.

In the device having two or more spiral springs, the spiral spring urges the drum together with the additional spring(s), and therefore, large balancing torque can be applied to the drum, and the torque load beared by a spring is reduced. Therefore, a good durability can be sufficiently secured.

In addition, in the device having an additional spiral spring in the drum, in connection that another spring is provided at a member separated from the drum, the size (especially the thickness) of the device can be advantageously reduced for space saving.

Hereinafter the present device of the invention is explained in more detail with reference to the embodiments shown in the attached drawings. However, it is to be understood that the present invention is not limited to those embodiments.

DETAILED DESCRIPTION OF THE INVENTION

Figure 1:
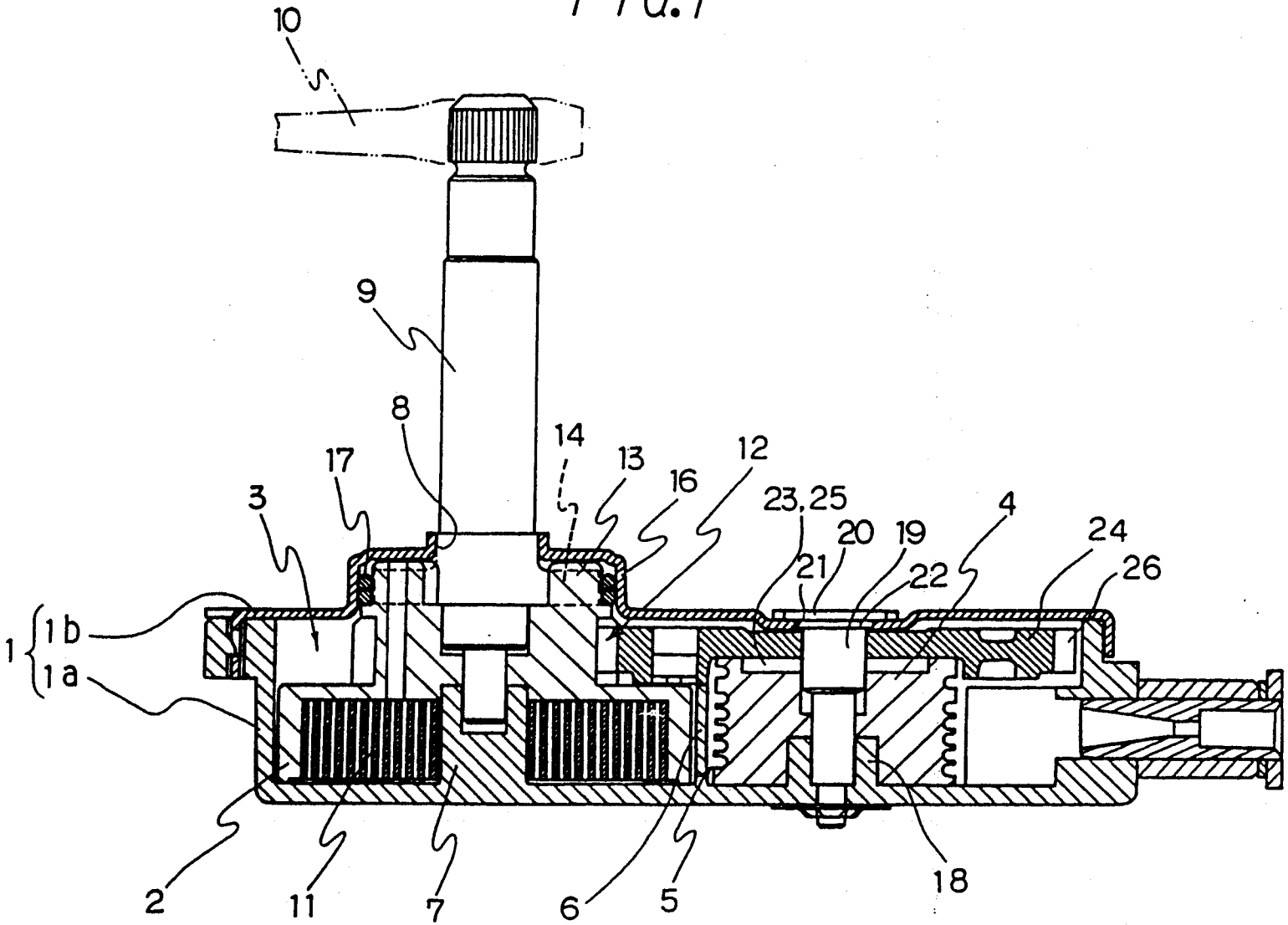
FIG. 1 and FIG. 2 are a sectional view and a perspective view showing an embodiment of the driving device of the present invention, respectively.

Referring to FIG. 1, a housing 1 comprises a body 1*a* and a lid 1*b*. The body 1*a* has a first compartment 3 for housing a spring case 2 which forms a rotatable member and a second compartment 5 for housing a drum 4. There is provided a partition 6 between the first compartment 3 and the second compartment 5.

The housing body 1*a* has a first boss 7 projecting from the center of bottom face of the first compartment 3.

The first boss 7 supports a driving shaft 9 together with an inner surface of a hole 8 of the lid 1*b* so that the driving shaft 9 is rotatable. Further, a driving means such as an electric motor or a crank handle 10 for actuating the driving device is connected with an end of the driving shaft 9 projecting through the hole 8. In the present embodiment of FIG. 1, a crank handle 10 is employed as a driving means.

A cup-like spring case 2 is rotatably mounted around the driving shaft 9 with upside down. The spring case 2 houses a spiral spring 11 which is previously wrapped around the first boss 7 therein. The spiral spring 11 has an end fixed to the first boss 7 and another end fixed to the spring case 2, so that the spring case 2 is urged in the direction of arrow A.

The spring case 2 has a first gear 12 integratedly formed at the upper peripheral portion thereof and known two fin-like engaging projections 13 at the upper end surface thereof. On the other side, the driving shaft 9 is provided with a flange 14 which has fin-like cut-off portions 15 which can engage with the engaging projections 13 with remaining some play in the rotational direction. As a result, a torque can be transmitted from the driving shaft 9 to the spring case 2, and from the spring case 2 to the driving shaft 9.

There is inserted a known brake spring 17 between the outer surface of the flange 14 and the inner surface of a tubular wall 16, and both ends 17*a* and 17*b* thereof are inserted through gaps between the cut-off-portions 15 and the engaging projections 13. The above-mentioned play between the flange 14 and the engaging projections 13 is for effectively performing of the brake spring 17.

At the center of the bottom of the second compartment 5 of the housing body 1*a*, a second boss 18 is projected for supporting a lower portion of a pin 19. The pin 19 has a head 20 at the top end thereof, and a step portion 22 is formed at a lower side (a pin-side) of the head 20. The step portion 22 is inserted through a slit 21 of the lid 1*b* for restricting rotation of the pin 19.

Figure 3:
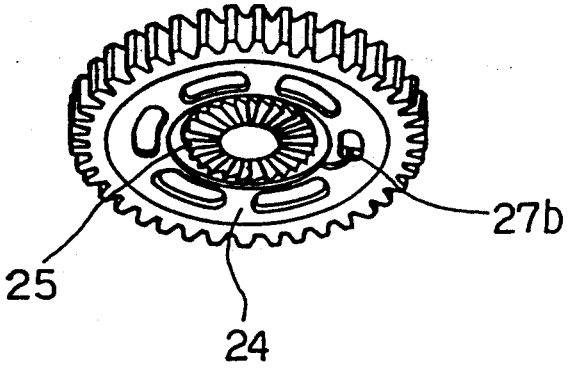
FIG. 3 and FIG. 4 are perspective views of a gear and a drum in the device of FIG. 1 shown from under side, respectively.

A drum 4 for winding and unwinding cables is rotatably mounted around the pin 19. The drum 4 is formed with a first set of radially extending ratchet teeth 23 at the upper side thereof. A second gear 24 for torque transmitting between the spring case 2 and the drum 4 is rotatably mounted around the pin 19 at the upper side of the drum 4. The second gear 24 is formed with a second set of radially extending ratchet teeth (25 in FIG. 3) to be engaged with the first ratchet teeth 23 at the lower side thereof. The sets of ratchet teeth 23, 25 are utilized for eliminating slack of cables when the window regulator is assembled, and the second gear 24 and the drum 4 rotate together as a one body after the lid 1*b* is securely attached to the body 1*a*. The second gear 24 has teeth 26 meshing with the first gear 12 therearound. Therefore, torque transmitting between the second gear 24 and the spring case 2 is realized.

Figure 4:
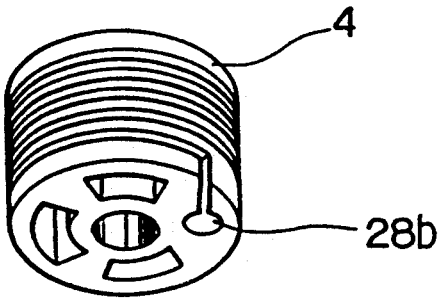

A first cable 27 for descending window glass and a second cable 28 for ascending window glass are wrapped around the drum 4. The end 27*a* of the first cable 27 is anchored in a first engaging recess (27*b* in FIG. 3) formed in the lower side of the second gear 24, and the end 28*a* of the second cable 28 is anchored in a second engaging recess (28*b* in FIG. 4) formed in the lower side of the drum 4. The first cable 27 and the second cable 28 extending from the drum 4, pass through holes or slits 29, 30 formed in the housing body 1*a* and conduits 31. Another ends of the cables 27, 28 are fixed to a carrier plate (72 in FIG. 5) firmly attached to the window glass (71 in FIG. 5). The cables 27, 28 and the conduits 31 form control cables (Bowden cable).

Figure 5:
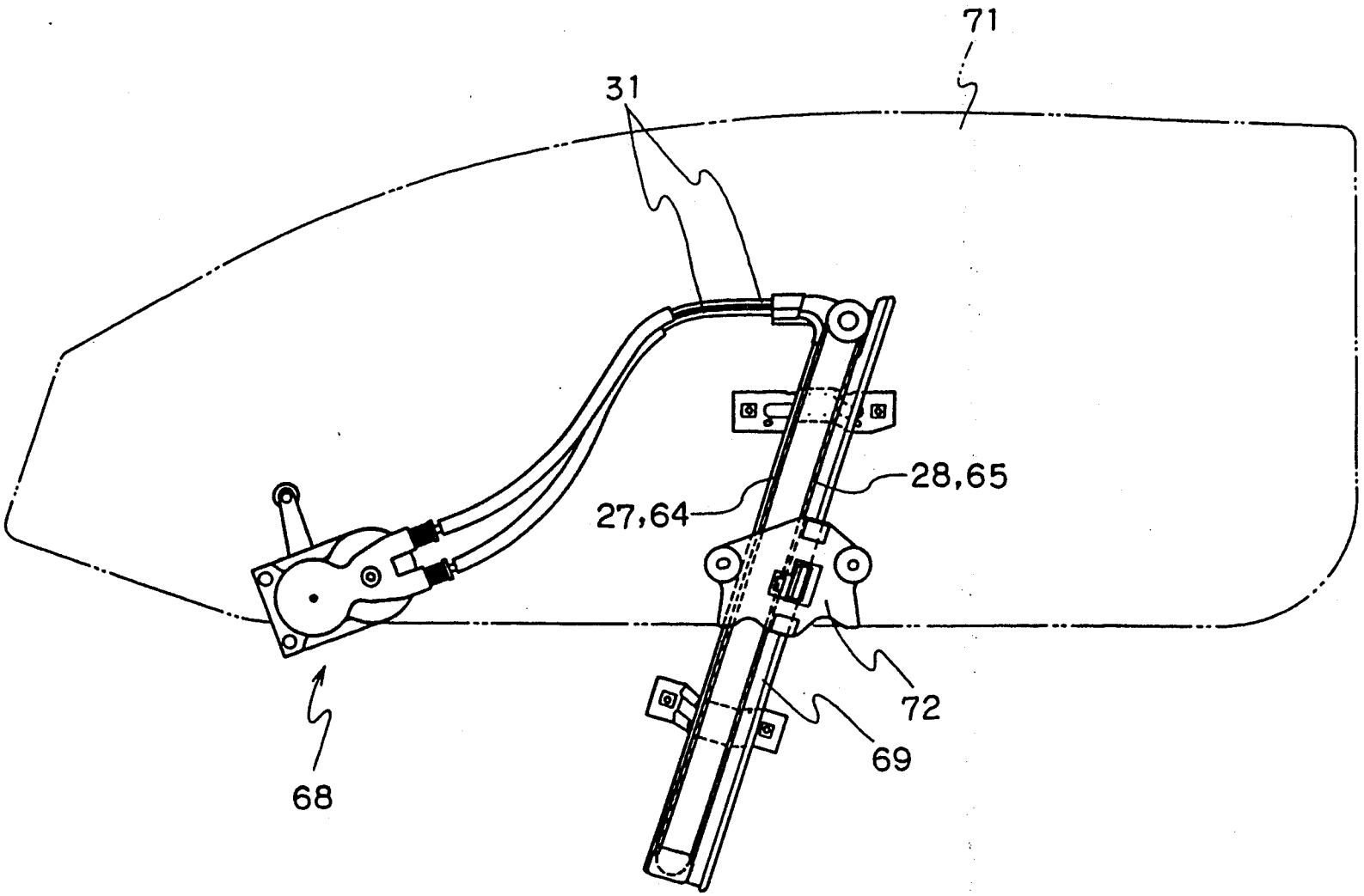
FIG. 5 is a front view showing an example of a window regulator having a driving device of the present invention in an attached state to an automobile.

The above-mentioned driving device is assembled in a window regulator, for example, shown in FIG. 5 and is attached to a door panel of an automobile. The driving device part and the guide rail part are connected with a pair of control cables.

Hereinafter, function and operation of the driving device constructed as mentioned above are explained with reference to FIGS. 1 and 2.

Figure 2:
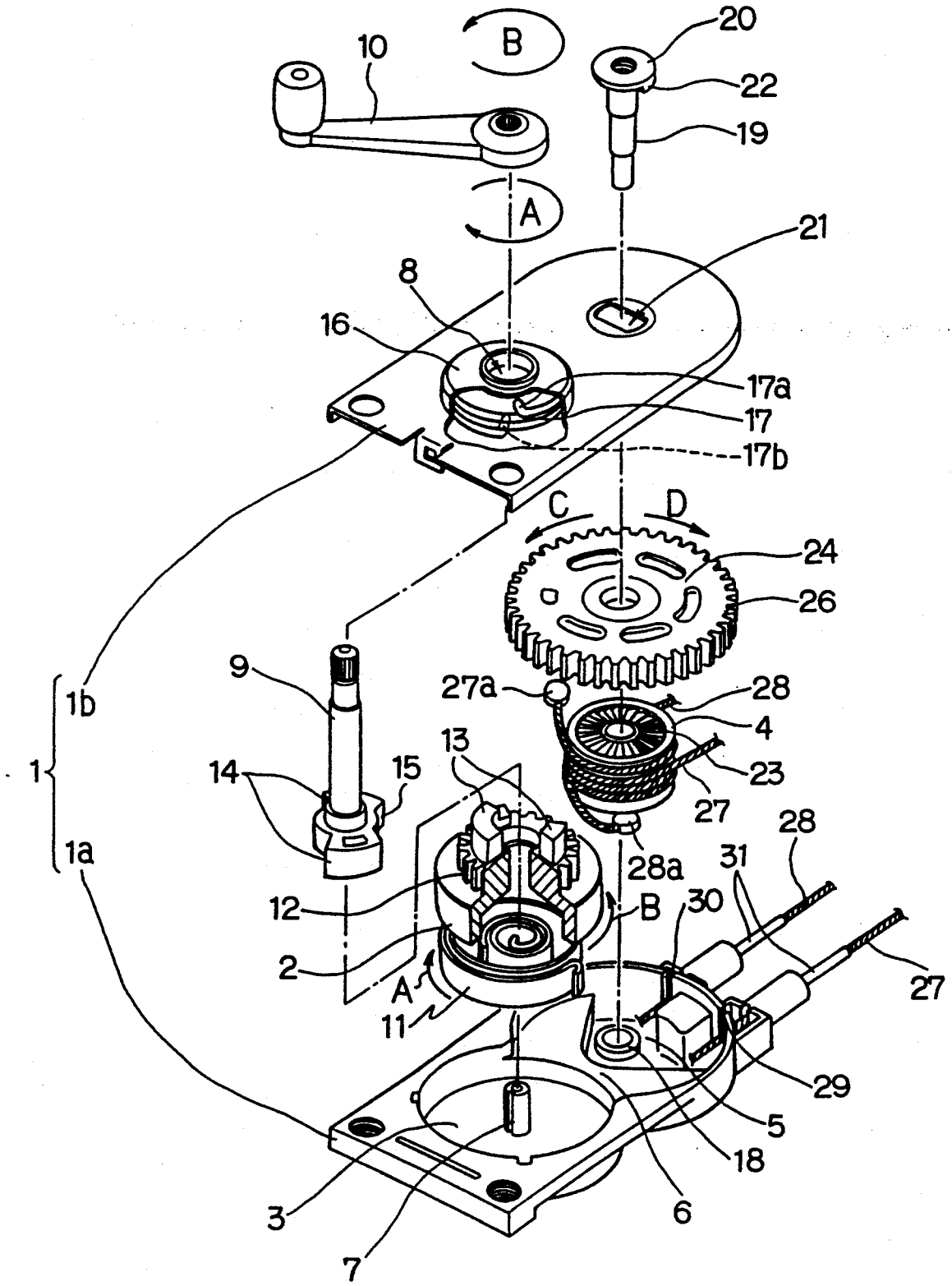

Referring to FIG. 2, when the crank handle 10 is rotated in the direction of arrow A, the spring case 2 is also rotated in the direction of arrow A due to the engagement between the cut-off portion 15 and the engaging projection 13. At the same time, the second gear 24 is rotated in the direction of arrow C due to the engagement between the first gear 12 and the teeth 26 of the second gear 24. The drum 4 is also rotated in the direction of arrow C due to the engagement between the first ratchet teeth 23 and the second ratchet teeth 25. In the present case, the second cable 28 is wound around the drum 4 and the first cable 27 is unwound. As a result, the window glass is lifted.

On the contrary, when the crank handle 10 is manually operated in the direction of arrow B, all members rotate inverse to the above mentioned. That is to say, the spring case 2 rotates in the direction of arrow B, and the second gear 24 and the drum 4 rotate in the direction of arrow D. As a result, the first cable 27 is wound up around the drum 4, and the window glass 71 is lowered.

Under the above situation, since the spiral spring 11 urges the spring case 2 to rotate in the direction of arrow A, the operation force is helped by the spiral spring when the window glass 71 is lifted.

That is to say, during the operation of the window regulator, larger operational force is generally required when the window glass is lifted due to the self weight of the window glass 71. However, since the above-mentioned spiral spring 11 reduces the load during upward operation and enlarges the load during downward operation, the upward operational force and the downward operational force are advantageously balanced.

Further, in the driving device of FIGS. 1 through 4, since each of the drum 4 and the spring case 2 is supported by the respective shaft, and is housed within the respective compartment, even if rain drops or the like enter in the housing along the cables, the spiral spring 11 is protected from getting wet.

Though, in the above-mentioned embodiment, the supporting shaft of the drum is parallel with the shaft of the spring case, the device of the present invention is not limited to such arrangement. If condition such as width of an inner space of the housing allows, the torque transmitting means might have a mechanism which transmits the torque transversely, for example, by using of a pair of bevel gears and the like.

Further, the device can be arranged such that the driving shaft with an electric motor or a crank handle is arranged at the drum side, and the spiral spring is supported by a pin.

In the above-mentioned driving device, since the drum for winding cables and the spiral spring are separately arranged with interposing a means for transmitting torque, the entered rain water or the like do not directly reach the spiral spring. Further, in a preferable case in which a partition is provided between the compartment for the spiral spring and the compartment for the drum, even if the water stick to the compartment for the drum, the water cannot come into the compartment for the spiral spring.

Hereinafter, with reference to FIGS. 6 to 8, another embodiment of the driving device of the present invention will be explained.

Though, in the present embodiment, main spiral spring can also be protected from rusting, the main view point of design is rather to enlarge the balancing force.

Figure 6:
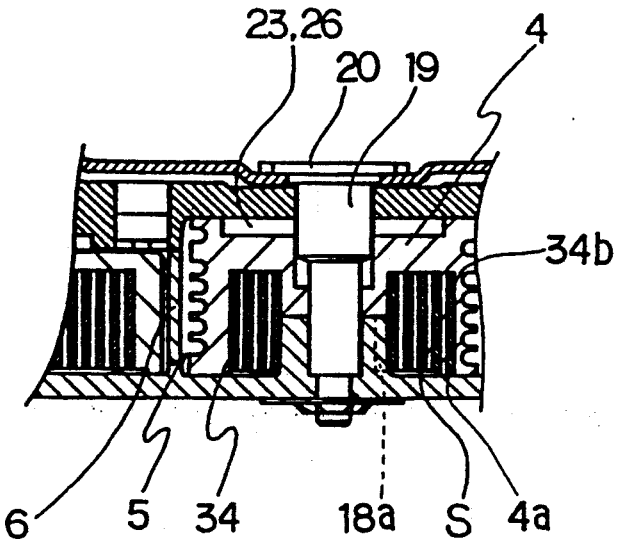
FIG. 6 is a partial sectional view showing another embodiment of the driving device of the present invention.
Figure 7:
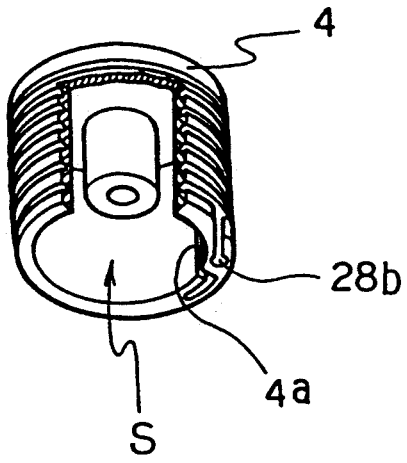
FIG. 7 is a partially-cut-away perspective view showing the drum of FIG. 6.

In the instant embodiment, the drum 4 has a recessed portion or hollow space S in the lower side thereof as shown in FIGS. 6 and 7, and an additional (second) spiral spring 34 is housed in the hollow space S. The inner end of the second spring 34 is bended inwardly at the lower half only, and the bended portion 34*a* is inserted in and engaged with a slit 18*a* of the second boss 18.

On the other hand, the outer end 34*b* of the spiral spring 34 is inserted in (and engaged with) a slit 4*a* formed in the inside wall of the drum 4.

The operation and function of the present embodiment are substantially the same as the device of FIGS. 1 to 4.

However, during ascending and descending operation, though the basic or main spiral spring 11 urges the drum 4 through the spring case 2, the first gear 12 and the second gear 24, the additional spring 34 directly urges the drum 4 so that the drum 4 rotates in the direction of arrow C. That is to say, the first spring 11 and the second spring 34 cooperate with each other to reduce the load during ascending operation and to enlarge the load during descending operation. Therefore, in case that the window glass is relatively heavy, both directional operations can be well balanced.

Figure 8:
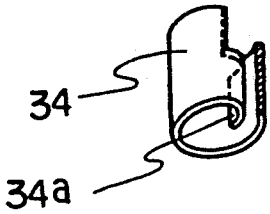
FIG. 8 is a partially-cut-away perspective view showing the additional spiral spring of FIG. 6.
Figure 9:
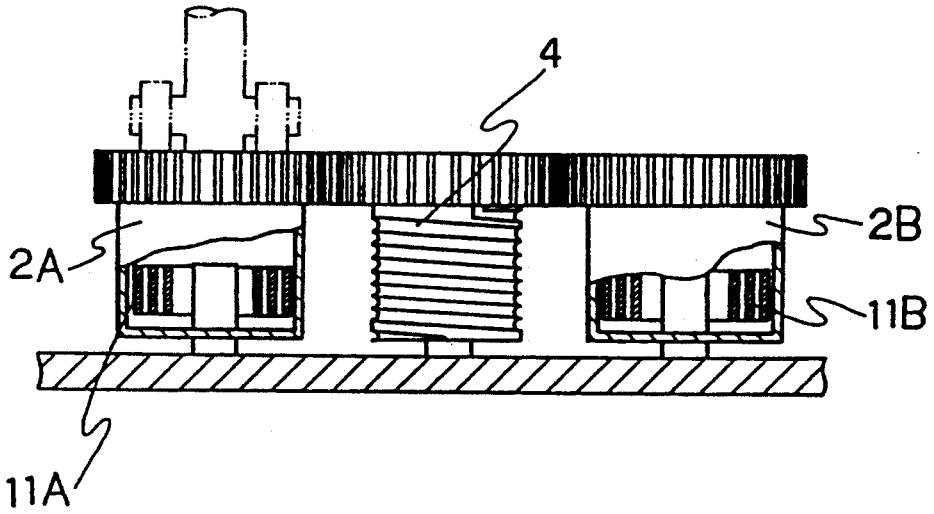
FIG. 9 is a partial sectional view showing further another embodiment of the driving device of the present invention.
Figure 10:
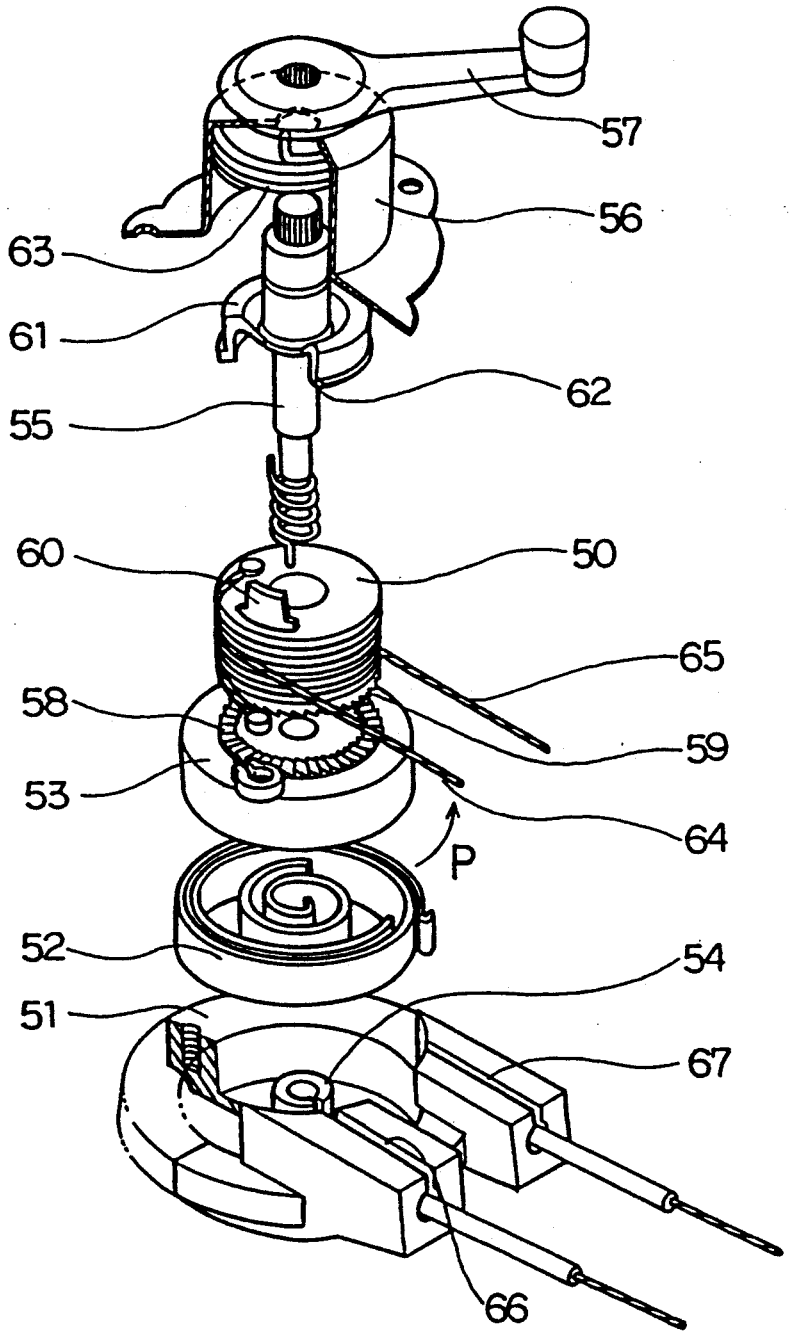
FIG. 10 PRIOR ART
FIG. 10 is a perspective view showing an example of conventional driving device.

Though in the device shown in FIGS. 6 to 8 according to the second aspect of the present invention, the drum 4 has a hollow space S and the second spring 24 is housed in the space S, there can be employed another aspect in which two spring cases 2A, 2B (two rotatable members) are arranged separatedly from the drum, each spring case 2A, 2B having spiral spring 11A, 11B respectively as shown in FIG. 9. In such embodiment, two large spiral springs 11A, 11B, together with the spring 34 in the drum 4 or instead of the spring 34, urge the drum 4, and therefore, a large balancing force can be obtained.

In the above-mentioned driving device, the drum for winding cables and the spring case are separately arranged with interposing a torque transmitting means therebetween, and the both members are urged with respective spiral spring. Therefore, in addition that a large balancing force can obtained, respective allotment of load for each spring can be reduced so as to increase endurance of the springs.

Further, in a case where the first spring is separately provided from the drum and the second spring is housed in the drum, the size of the device, especially in the direction of thickness of a door panel of an automobile, can be advantageously reduced.

Though several preferable embodiments are described above, it is to be understood that the present invention is not limited to the embodiments, and various changes and modifications may be made in the invention without departing from the spirit and scope thereof.

What is claimed is:

1. A driving device for a cable type window regulator, comprising:

(a) a housing;

(b) a drum rotatably supported by the housing, for winding and unwinding cables for actuating a window glass;

(c) a rotatable member rotatably supported by the housing, which is separated from the drum;

(d) a spiral spring arranged concentrically with the rotatable member so as to urge the rotatable member in a rotational direction; and (e) a torque transmitting means for transmitting a torque between the drum and the rotatable member, said housing comprising a first compartment for housing said spiral spring, a second compartment for housing said drum, and a partition provided between said first compartment and said second compartment.

2. The driving device of claim 1, wherein said first compartment comprises a cup-like spring case for covering said spiral spring.

3. The driving device of claim 1, wherein said partition includes a through portion for inserting said torque transmitting means.

4. The driving device of claim 1, wherein a driving means is connected to said rotatable member, and an operation of rotation of the driving means is transmitted to the drum through the rotatable member and the torque transmitting means.

5. The driving device of claim 1, wherein a rotational axis of the rotatable member is parallel with a rotational axis of the drum, and said torque transmitting means comprises a first gear formed at a periphery of the rotatable member and a second gear meshing with the first gear and connected with the drum such that torque can be transmitted to each other.

6. The driving device of claim 1, wherein a driving means is connected to said drum, 7. The driving device of claim 1, wherein said drum has a cup-like shape, and a second spring is housed in the drum so that the second spring urges in the same direction as that by the spiral spring.

8. A driving device for a cable type window regulator, comprising:

a housing;

a drum rotatably supported by the housing, for winding and unwinding cables for actuating a window glass;

a rotatable member rotatably supported by the housing, said rotatable member being separated from said drum and parallel with a rotational axis of said drum;

a spiral spring arranged concentrically with the rotatable member so as to urge the rotatable member in a rotational direction; and a torque transmitting means for transmitting a torque between the drum and the rotatable member, said torque transmitting means comprising a first gear formed at a periphery of the rotatable member and a second gear meshing with the first gear and connected with the drum such that torque can be transmitted to each other, wherein said drum is provided with a first set of radially extending ratchet teeth at a side facing the second gear, and said second gear is provided with a second set of radially extending ratchet teeth capable of meshing with the first set of ratchet teeth.

9. A driving device for a cable type window regulator, comprising:

a housing;

a drum rotatably supported by the housing, for winding and unwinding cables for actuating a window glass;

a rotatable member rotatably supported by the housing, said rotatable member being separated from said drum and parallel with a rotational axis of said drum;

a spiral spring arranged concentrically with the rotatable member so as to urge the rotatable member in a rotational direction; and a torque transmitting means for transmitting a torque between the drum and the rotatable member, said torque transmitting means comprising a first gear formed at a periphery of the rotatable member and a second gear meshing with the first gear and connected with the drum such that torque can be transmitted to each other, wherein an effective diameter of said second gear is larger than an effective diameter of said first gear.

10. A driving device for a cable type window regulator, comprising:

(a) a housing;

(b) a drum rotatably supported by the housing, for winding and unwinding cables for actuating a window glass;

(c) a first rotatable member and a second rotatable member each of which is rotatably supported by the housing, and is separated from the drum;

(d) a first torque transmitting means and a second torque transmitting means which transmit a torque between the drum and the first rotatable member and a torque between the drum and the second rotatable member; and (e) a first spring and a second spring for urging the drum to rotate in a window-lifting direction through the first rotatable member and the first torque transmitting means, and the second rotatable member and the second torque transmitting means, respectively so that a window glass is lifted.

11. The driving device of claim 10, wherein said first and second rotatable members have spring cases for covering the first and second springs, respectively.

12. The driving device of claim 10, wherein a driving means is connected to said first rotatable member and an operation of rotation of the driving means is transmitted to the drum through the first torque transmitting means.

13. The driving device of claim 10, wherein rotational axes of the drum, the first rotatable member and the second rotatable member are parallel with each other;

the first torque transmitting means comprises a first gear formed on the first rotatable member and a second gear meshing with the first gear and being connected with the drum; and the second torque transmitting means comprises a third gear formed on the second rotatable member and the second gear meshing with the third gear.

14. The driving device of claim 13, wherein said drum is provided with a first set of radially extending ratchet teeth at a side facing the second gear; and the second gear is provided with a second set of radially extending ratchet teeth capable of meshing with the first set of ratchet teeth.

* * * * *